US006363696B1

(12) United States Patent
Tisma

(10) Patent No.: US 6,363,696 B1
(45) **Date of Patent: *Apr. 2, 2002**

(54) MANDREL FOR AN AUTOMATIC PACKAGING MACHINE FOR CARDBOARD BOX WITH A LATCHING FLIP TOP

(75) Inventor: Petar Tisma, Elk Grove, IL (US)

(73) Assignee: Tisma Machinery Corporation, Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/613,644

(22) Filed: Jul. 11, 2000

Related U.S. Application Data

(62) Division of application No. 09/324,413, filed on Jun. 2, 1999, now Pat. No. 6,195,959.

(60) Provisional application No. 60/087,626, filed on Jun. 2, 1998.

(51) Int. Cl.[7] ..... B65B 43/42

(52) U.S. Cl. ..... 53/574; 53/138.1; 53/138.3; 53/579; 53/563

(58) Field of Search ..... 53/138.1, 138.3, 53/138.7, 574, 579, 563, 377.6, 238; 493/164, 260

(56) References Cited

U.S. PATENT DOCUMENTS

| | | | | | |
|---|---|---|---|---|---|
| 3,583,131 | A | * | 6/1971 | Gaudlitz | 53/138.3 |
| 3,956,865 | A | * | 5/1976 | Schmermund | 53/29 |
| 4,523,422 | A | * | 6/1985 | Ilsemann | 53/566 |
| 4,612,752 | A | * | 9/1986 | Deal | 53/377 |
| 5,806,289 | A | * | 9/1998 | Sassi et al. | 493/164 |
| 6,073,423 | A | * | 6/2000 | House et al. | 53/579 |

* cited by examiner

*Primary Examiner*—Peter Vo
*Assistant Examiner*—Sam Tawfik
(74) *Attorney, Agent, or Firm*—Michael Best & Friedrich LLC; J. Warren Whitesel

(57) ABSTRACT

An automatic packaging machine for forming and filling a latching flip-top box uses a two part mandrel which are joined by a hinge. One of the two hinged parts has a roller thereon for following a cam track having a quarter turn spiral therein. As the roller follows the spiral causing one hinged part to move through a quarter turn causing the flip-top to fold over and be formed. A somewhat loose tab on the top edge of the bottom of the box is a latch tab which is caught when the flip-top folds over.

4 Claims, 4 Drawing Sheets

MANDREL FOR AN AUTOMATIC PACKAGING MACHINE FOR CARDBOARD BOX WITH A LATCHING FLIP TOP

This application claims the benefit of U.S. Ser. No. 60/087,626, filed Jun. 2, 1998. This is a division of U.S. Ser. No. 09/324,413 U.S. Pat. No. 6,195,959.

BACKGROUND OF THE INVENTION

This invention relates to automatic packaging machines and more particularly to method of and means for folding, forming and closing self-latching boxes with a flip top.

Reference is made to the following U.S. Patents, assigned to the assignee of this invention, which provide background information on automatic packaging machines: U.S. Pat. Nos. 4,578,929; 4,548,593; 4,716,714; 4,829,751; 4,856,566; 4,982,556; 5,010,929; 5,072,573; and 5,144,790. Co-pending U.S. patent application Ser. Nos. 08/848,127 filed Apr. 27, 1997 and 08/856,443 filed May 14, 1997 are examples of a type of packaging machines which may be used to load small items, such as candy-coated chewing gum into a different kind of box.

Conventional automatic packing machines have a conveyor, usually an endless link chain conveyor, which travels through or past a number of work stations extending between a magazine containing package blanks and a product discharge end. Usually, the package blanks are a stack of die cut cardboard blanks which are picked up one-at-a-time by vacuum cups and then put into box forming mandrels carried by the conveyor. Tabs and flaps on the bottom of the blank are folded by plows and sealed in order to close the box. Then a pre-determined amount of product is placed in the box. Next, tabs and flaps forming a top of the box are folded and sealed. Then the box is discharged on to any suitable conveyor, into a shipping carton, or to another device for receiving the completed product containing packaging.

Conventionally, a plow is a strip of metal, or the like, extending along a length of the conveyor and in a location where the tabs and flaps are to be folded. First, tabs and flaps forming the bottom of the box encounter the plows and they are folded as the conveyor carries the box past the plow. Then, a pre-determined amount of product is placed in the box. Next, tabs and flaps forming a top of the box are folded and sealed in a similar manner. Depending upon product packaging needs, the box may or may not be wrapped in a transparent film which is sealed. Finally, the box is discharged on to any suitable conveyor, into a shipping box or to another suitable device for receiving the product containing packaging.

Often, the product presents special considerations which require the packaging machine to perform unique functions as the box is formed and filled. These functions may be performed by special parts which are attached to or positioned near the conveyor. Many examples of such special parts are shown and described in the above-cited patents.

SUMMARY OF THE INVENTION

This invention is directed to a problem which is exemplified by a "flip-top" box for small items, such as candy coated chewing gum or the like. Such a box is made from a single, unitary, die cut blank of thin cardboard stock. A flip-top box has a bottom section is in the form of a rectangular parallelepiped. The top of the box is in the form of a hood connected to the bottom along a crease line which acts as a hinge. The hood moves away from or over the top of the box in order to open or close it. It is necessary for the packaging machine to first form the blank into the box, then count a specific number of small item, here candy coated chewing gum, next deposit them in the box, and finally close and seal the box.

One particular box requiring a unique treatment has a number of tabs which are folded in such a manner that the flip-top is "latched" in a closed position and yet is easily opened, closed, and relatched with only a small amount of force. This invention relates to a packaging machine for folding and sealing the various flap and tabs which form the latching flip-top.

In keeping with an aspect of the invention, a plurality of mandrels are bolted to an endless link chain conveyor. The mandrel has two parts, one of which is hinged to the other with a coiled spring bias urging the two parts away from each other and into a normal or straight configuration. A first of the two parts is bolted in a fixed position to and immobilized on the conveyor link chain. The second and hinged part of the mandrel has a roller thereon which rides in a cam track located adjacent a portion of the link chain conveyor in order to articulate the hinged section part to a somewhat right angle configuration over the first part in order to form and close the flip-top of the box. Plows alongside the conveyor press tabs into place where they are secured by glue, thereby forming the flip-top. The plows also press a latching tab into a loosely folded position where it is caught by the tabs on the flip-top, thereby creating a latching condition.

BRIEF DESCRIPTION OF THE DRAWINGS

A preferred embodiment of the invention is shown in the attached drawings, in which.

DETAILED DESCRIPTION OF THE INVENTION

Figure 1:
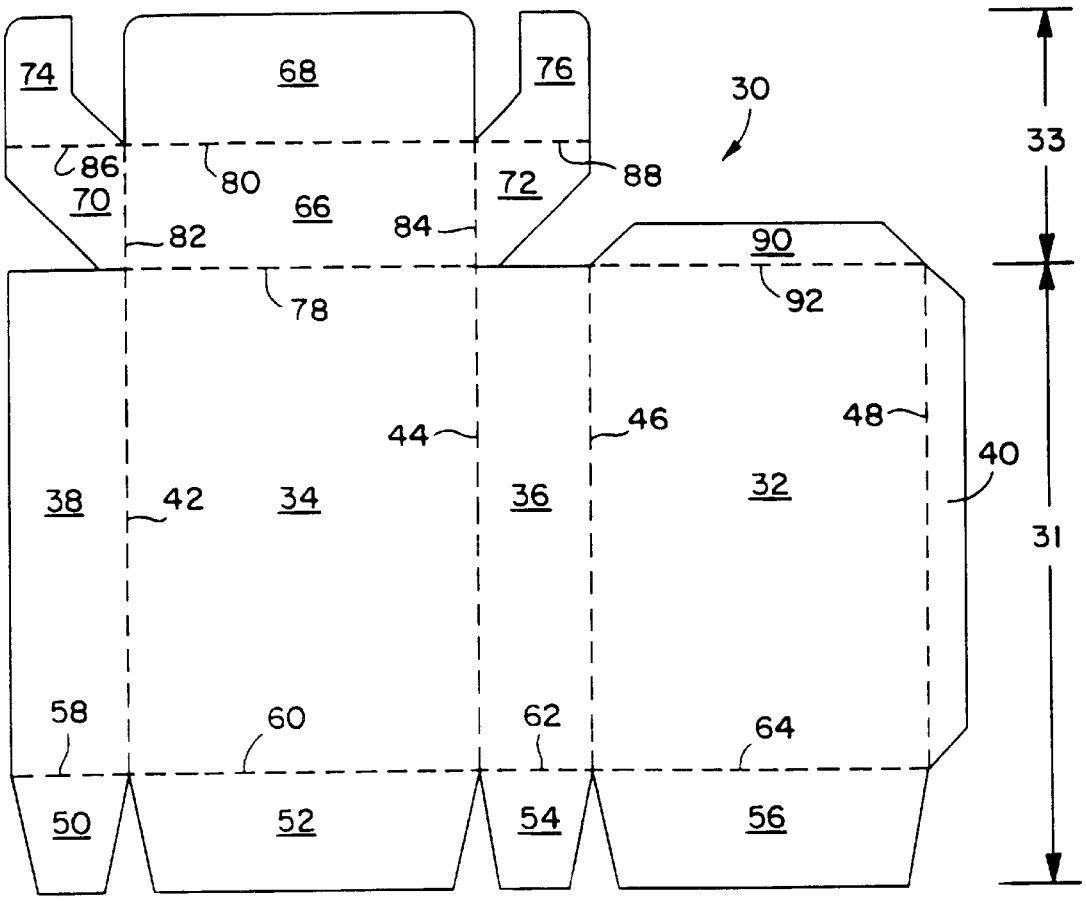
FIG. 1 is a plan view of a cardboard blank which can be formed into the latching flip-top box.

FIG. 1 shows a cardboard blank 30 for providing a latching flip-top box which is folded, formed, filled, and sealed by the inventive automatic packing machine. The box part is formed by panels in section 31 and the flip-top part is formed by the panels in section 33. The box portion of the blank, section 31, includes front and back panels 32, 34, respectively, joined on opposite edges of central side panel 36. A side panel flap 38 is attached to the left side of back panel 34 and a glue flap 40 is attached to the right side of the front panel 32. The blank is formed into a tube by folding along the crease lines 42–48, and gluing flap 40 onto flap 38. The bottom of the blank has dependent tabs 50–56 which close the bottom of the box in any suitable and conventional manner by folding along crease lines 58–64 and gluing in place.

Section 33 of the blank provides the flip-top 65 which is formed by a top section 66, a front section 68, two side sections 70, 72, and two keeper section 74, 76. The top and front sections 66, 68 fold along crease line 78 and project over the front and back sections. The side sections 70, 72 are folded along crease lines 82, 84 to project perpendicularly away from the back panel 34. Next, the keeper sections 74, 76 are folded along crease lines 86, 88 to come into confrontation with the inside surface of front section 68 after it is folded down along crease line 80. There, the keeper sections 74, 76 are glued in place to the back of front section 68. The final configuration of box 31, including the flip-top 33, is shown in FIG. 2 where the keeper sections 74, 76 are seen glued to the inside surface of the front section 68.

Attached to the top of front panel 32 is a latching tab 90 which is loosely folded along crease line 92 so that the lower edge 94 of the latching tab 90 projects slightly away from front panel 32 of the box.

Figure 2:
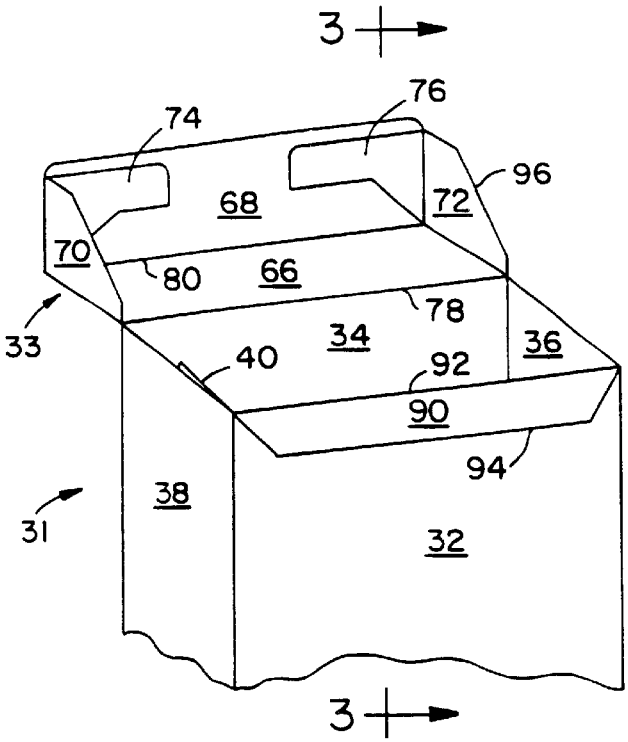
FIG. 2 is a perspective view of an upper part of the flip-top box.
Figure 3:
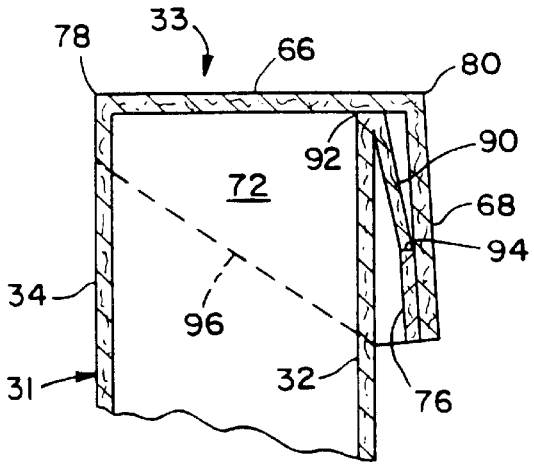
FIG. 3 is a cross section taken along line 3—3 of FIG. 2 and showing the flip-top box with top closed and latched.

The latching action is seen in FIG. 3, which is a cross section of the box, with the flip-top 33 in a closed position. The flip-top 33 includes top section 66 and front section 68 which folds along crease line 78 that acts as a hinge. On the far side of the box, as viewed in FIG. 3, side section 72 is shown by phantom line 96. The loosely folded latching tab 90 projects slightly away from the front panel 32 so that edge 94 is caught by an edge of keeper section 76. The flexibility of the latching tab 90 enables it to be released from the keeper section 76 when the flip-top is manually opened to the position shown in FIG. 2. Yet, the resilience of the latching tab 90 is such that the top is again captured when the lid is closed.

The invention provides an automatic packaging machine forms, fills and closes the box shown and described in FIGS. 1–3, by means of the mandrel 100 shown in FIGS. 4–8.

Figure 8:
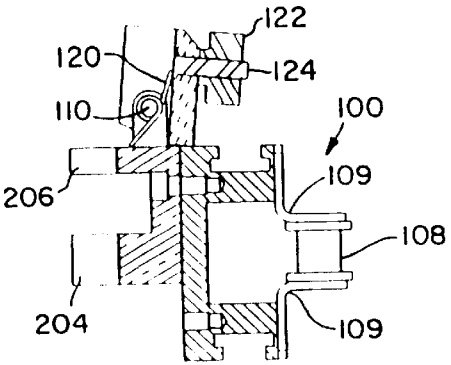
FIG. 8 is a cross section taken along line 8—8 of FIG. 6.
Figure 5:
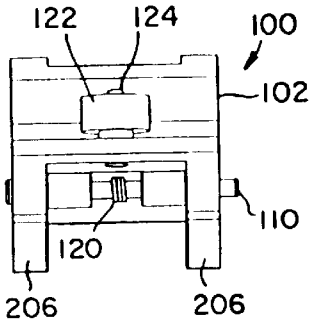
FIG. 5 is a top plan view of the assembled mandrel of FIG. 4.
Figure 6:
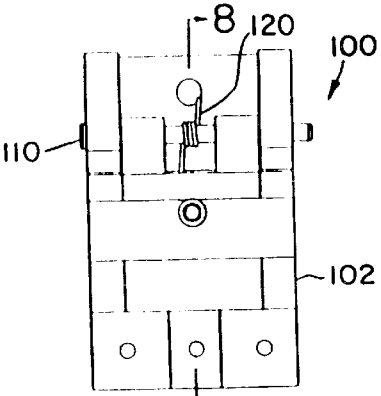
FIG. 6 is a front elevation view of the assembled mandrel.

The mandrel 100 has three principle parts: a mounting block 102, a box carrier 104 and a flip-top former 106. The mounting block 102 is bolted to a suitable conveyor (usually a link chain) 108 (FIGS. 7 and 8) via brackets 109, 109 so that it is carried by and moves with the conveyor. The box carrier 104 is a first part bolted to the mounting block 102 so that it is also carried by and moves with the conveyor. A hinge pin 110 which presses through holes 112–118 mounts a second part which is the flip-top former 106 on the box carrier 104. A spring 120 (FIGS. 5, 6, 8) is mounted on the center of the hinge pin 110 and between holes 114, 116 in order to bias the box carrier 104 and flip-top former 106 to a generally straight configuration, as shown in FIGS. 7A and 8.

A shaft 124 passes through section 106 and provides an axle for a guide roller 122 which is positioned to move along a cam track located along a portion of the conveyor. Normally, the cam track has a surface aligned with the tire of guide roller 122, thus placing it in the position shown in FIGS. 7A and 8 so that the normal and unarticulated relationship between the box carrier 104 and the flip-top former 106 is approximately straight.

When the conveyor 108 moves the mandrel 100 to the location where the flip-top is to be formed, the cam track surface has a spiral turn of about 90°. This turn causes the roller to move its posture so that its tire follows the turned cam track surface. Responsive thereto, flip-top former 106 swings on hinge pin 110 to as articulated box closing position (FIG. 7B) over the top of the box so that the flip-top is formed and closed.

Figure 7B:
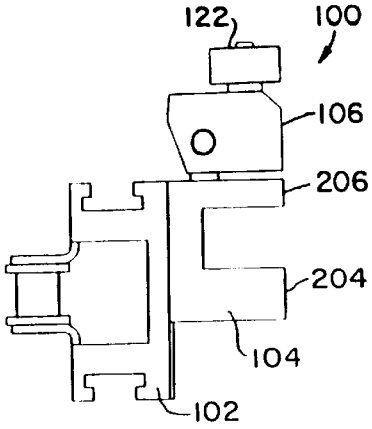
FIG. 7B is a similar view, but in an articulated box closing position.
Figure 7A:
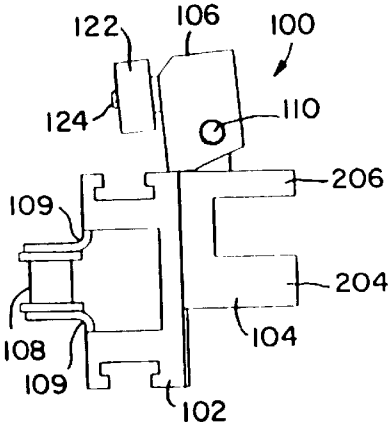
FIG. 7A is a side elevation view of the assembled mandrel in a normal straight and unarticulated position.

After the box is closed, the surface of the cam track returns to its normal alignment causing the roller 122 to return to the normal position (FIG. 7A). As it does, spring 120 urges the flip-top former 106 to return to the straight position shown in FIGS. 7 and 8.

Figures 9, 9A, 10, 11:
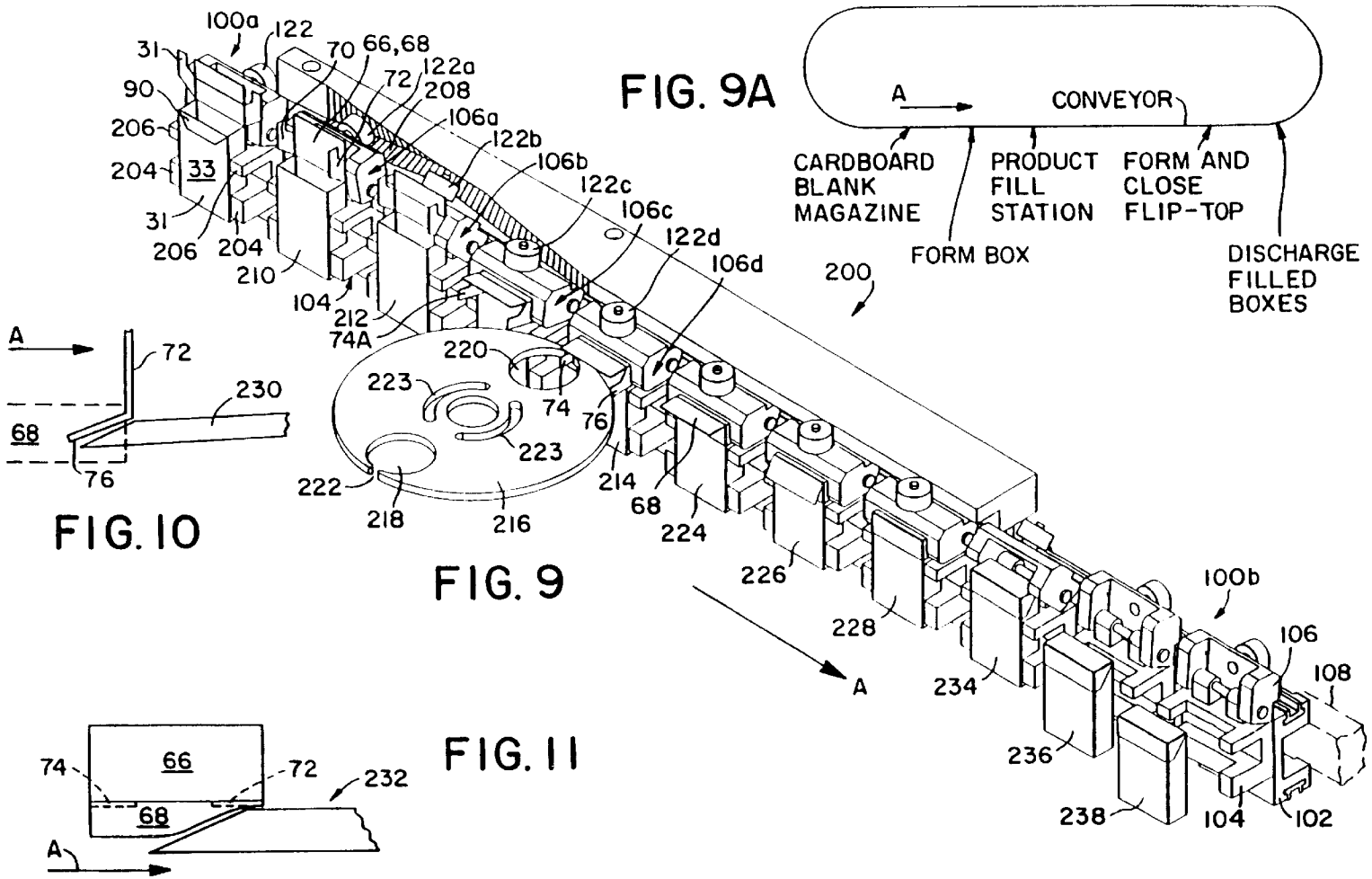
FIG. 9A schematically shows a conveyor for forming, filling, and closing a latching a flip-top box.
FIG. 9 is a portion of the conveyor of FIG. 9A for forming and closing a flip-top box.
FIG. 10 shown a plow for closing a leading keeper tab.
FIG. 11 shows a plow for closing sealing a front section of the flip-top.

FIG. 9A schematically shows a conveyor as a link chain moving around an endless oval track extending past a plurality of work stations where cardboard blanks are picked up one-at-a-time from a magazine, a box is formed, product is deposited in the box, the flip-top is formed and closed, and finally the filled box is discharged.

Figure 4:
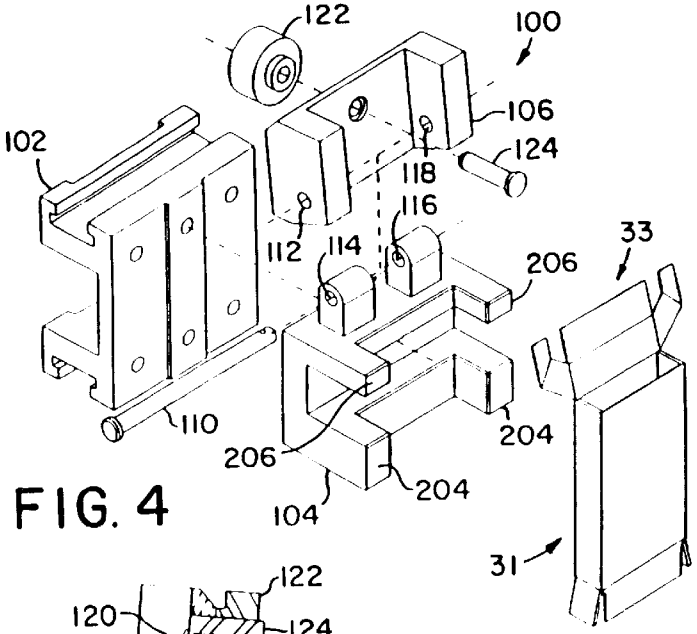
FIG. 4 is an exploded, perspective view of a mandrel used to form and close the flip-top box.

FIG. 4 shows a portion 200 of the conveyor of the automatic packaging machine of FIG. 9A where the mandrels 100 are performing the flip-top forming functions. A conveyor 108, represented at the right hand edge of FIG. 9, may be an endless link chain following the somewhat oval path having a plurality of work stations associated therewith. The mounting blocks 102 of mandrels 100 are bolted to and carried by the conveyor 108 so that there is an endless stream of mandrels moving in direction A from position 100*a* at the left-hand end of FIG. 9 to position 100*b* at the right-hand end thereof and on around the conveyor to return to the position at 100*a*.

Before the boxes reach position 100*a*, the bottom tabs and flaps 50–56 have been closed and sealed in any conventional manner. Thereafter, a correct amount of product has been places in each box, again in any suitable manner. Therefore, all of the boxes shown in FIG. 9 are ready for a final formation and closure of the flip-top.

In greater detail, the box formed of the bottom part 31 of the blank 30 is received in and embraced, carried and formed by two pairs of arms 204, 206 (FIGS. 4 and 9). The latching tab 90 is shown on the box at position 100*a*. In the interest of greater clarity, the tab 90 is not shown at other locations in FIG. 9; however, it should be understood that the latching tab 90 is present on all boxes.

A cam track shown at 208 extends along the conveyor and in a location adjacent the area where the flip-top 31 is formed and closed over box 33. In the area adjacent box 100*a* and mandrel 210, the surface of the cam track is parallel to the tire of roller 122*a* with the two mandrel parts 102, 106 in the unarticulated position. Springs 102 holds the mandrel box carrier 104 and flip-top former 106 in the normal straight and unarticulated configuration shown in FIGS. 7A and 8.

Beginning at the position of box 210, the cam track 208 makes a slow, spiral, 90° turn so that by the location of the box 212, the surface of the cam track and the angle of roller 122*b* is changed by about 45°. The spiral turn continues so that by the location of roller 122*d*, the surface of the cam track and the angle of the roller has changed by about 90° to the articulated top closing position shown in FIG. 7B. After the position 228, the flip-top former 106 returns from the articulated position to the unarticulated position again under the influence of a cam track (not shown) and the urging of spring 120.

At the position of box 100*a,* the flip-top 33 of the blank still has the flat configuration that is shown in FIG. 1. As the cam track spiral causes the roller 122*a* to begin a rotation of the flip-top former 106, the side panels 70, 72 are folded along crease lines 82, 84 (FIG. 1) and brought to stand at 90° with respect to the top and front sections 66, 68. As the cam track spiral continues, the roller 122*d* brings the flip-top former 106*d* to articulated position FIG. 7B which closes the flip-top over the box 33.

The box at position 214 encounters a tab tucker disk 216, which is mounted to rotate in front of the box. Disk 216 has two relatively large circular holes 218, 220, each with a rim opening such as shown at 222. Two arcuate slots 223 enable the rotational position of this tucker disk plate 216 to be properly aligned with the side panels 70, 72, as they are being held in the mandrels. Then bolts passing through the slots are tightened to hold the tucker disk plate 216 in aligned place. As the box 214 moves past the rim opening, the trailing keeper section 74 fits into the opening. The tucker disk plate 216 rotates far enough to bring the keeper section 74, over the front of the box and into the position under front section 68 where it will be secured in place, as shown in FIG. 2. The trailing keeper section 74A on the next box is caught in rim opening 222. The leading keeper section 76 encounters a stationary plow 230 (FIG. 10) which closes it under the front section 68, shown in phantom.

At position 224 (FIG. 9), the top has been formed except that the front section 68 still projects at 90° away from the box and over the two folded keeper sections 74, 72. At this point, the box encounters another plow 232 (FIG. 11) where the front section 68 is closed over both the front box side 32 and keeper sections 70, 72. Just before the front section 68 is so closed, a glue gun squirts a small amount of glue between the underside of front section 68 and the outer surfaces of keeper sections 74, 76, thereby securing therein the positions shown in FIG. 2.

At position 234, the flip-top is completed and folded over and latched to the front of the box. At position 236, the completed box is discharged from the mandrel, where any suitable means is provided to carry to box 238 away for disposition.

Those who are skilled in the art will readily perceive modifications which fall within the true scope and spirit of the invention. Therefore, the appended claims are to be construed at cover all equivalent structures.

What is claimed is:

1. A two part mandrel for use in an automatic packaging machine, said mandrel including two parts which are interconnected by a hinge, a first of said two hinged parts being adapted to be fixed on a flexible conveyor loop, a second of said two parts being hinged to said first part at a location where said second part stands above said first hinged part, means on said first hinged part for receiving, forming and supporting a container having a flip-top in a position where said top confronts said second hinged part, a cam track follower on said second hinged part for selectively moving said second hinged part in response to a movement of said conveyor part a cam track which extends over part of a conveyor path, said second hinged part moving from a position above said first part to an articulated position extending at approximately right angles thereto and over a top of said container, and means on said second hinged part for forming and closing said flip-top over the container as said second hinged part moves to said articulated position.

2. The mandrel of claim 1 wherein said cam follower is a wheel rotatably mounted on said second hinged part.

3. The mandrel of claim 2 wherein said first hinged part has at least one pair of arms for receiving, embracing, and carrying said container as said conveyor moves, said second hinged part has another pair of arms for engaging and folding a pair of keeper panels on said flip-top to an extended position as said second hinged part moves to said articulated position.

4. The mandrel of claim 3 and a tucker plate for catching and moving one of said extended keeper panels to a final position for catching a latching tag on said container received in said first hinged part, plow means for moving the other of said pair of keeper panels to said final position, and means for attaching said pair of keeper panels in said final position against a front section of said flip-top.

* * * * *